United States Patent [19]

Sorenson

[11] Patent Number: 4,929,807

[45] Date of Patent: May 29, 1990

[54] MINIATURE ILLUMINATED ROCKER SWITCH AND CASE THEREFORE

[75] Inventor: Richard W. Sorenson, Avon, Conn.

[73] Assignee: Carlingswitch, Inc., Plainville, Conn.

[21] Appl. No.: 313,383

[22] Filed: Feb. 21, 1989

Related U.S. Application Data

[63] Continuation-in-part of Ser. No. 165,744, Mar. 9, 1988, Pat. No. 4,853,503.

[51] Int. Cl.[5] ..... H01H 9/04

[52] U.S. Cl. ..... 200/296

[58] Field of Search ..... 200/296, 295

[56] References Cited

U.S. PATENT DOCUMENTS 3,274,358 9/1966 Hallerberg ..... 200/296

4,354,078 10/1982 Yoshimura ..... 200/296

*Primary Examiner*—Renee S. Luebke

*Attorney, Agent, or Firm*—McCormick, Paulding & Huber

[57] ABSTRACT

A miniature switch case has integrally molded mounting wings adjacent the case corners. These wings pivot on axes parallel to but spaced inwardly of the corners, and recesses at the case corners provide clearance for the wings as they are moved during installation of the case into a rectangular panel opening. The miniature case also has two movable contact levers shorter than the internal length of the case cavity to provide space for a lamp, and for a resistor in circuit with the lamp.

17 Claims, 5 Drawing Sheets

MINIATURE ILLUMINATED ROCKER SWITCH AND CASE THEREFORE

BACKGROUND OF THE INVENTION

This application is a continuation-in-part to a copending application entitled MINIATURE ILLUMINATED ROCKER SWITCH filed by Richard W. Sorenson on Mar. 9, 1988 and identified in the U.S. Patent and Trademark Office by Ser. No. 165,744, now U.S. Pat. No. 4,853,505. That application also deals with a miniature illuminated rocker switch and associated case. The invention to be described and claimed in this application deals with the external configuration of the rocker switch case itself, and with the external electric circuit connections that are adapted to be made to a five terminal version of such a rocker switch.

SUMMARY OF THE INVENTION

The invention on disclosed in the above-identified copending patent application relates to miniature double pole electrical switches having an illuminated rocker/actuator. The miniature switch of that disclosure has an upwardly open molded plastic case in which the bottom wall is generally integrally formed with the front, rear and end walls to define an upwardly open switch case cavity. The case has an internal divider wall providing front and rear cavities for two contact levers. The fixed center contact terminals are provided in aligned center slots in the bottom wall and support these movable levers on edge in these front and rear cavities. Each movable contact lever has a free end for engaging an associated fixed contact adjacent one end of the case, and the opposite end of each contact lever defines a pivoted end support on an associated center fixed contact.

As a consequence of this geometry the contact levers are relatively short. Furthermore these contact levers are provided in associated cavities in close proximity to the front and rear walls of the case. This arrangement for the contact levers provides sufficient space on the opposite side of the case cavity to house a conventional electrical lamp mounted in a receptacle defined by a divider wall between the switch case cavities. The movable contact levers are engaged by spring means acting between the rocker or actuator and a land defined by each lever above its pivoted end. The rocker is movable and operates the contact levers in unison to achieve opening and closing of the switch contacts while nevertheless allowing sufficient room for the relatively large lamp means in the relatively small or miniature switch case. A resistor is provided between the contact levers, again in centered relationship to the divider wall defining the switch case cavities, and this wall also defines slots for receiving conductive leads from the lamp means to facilitate assembly of the lamp and resistor in the switch case. The resistor preferably comprises a simple wire wound type with metal end caps, that is it does not include lead wires and/or any plastic covering of the type generally provided with such resistors.

The switch contacts or terminals are preferably formed from an initially flat stock, with the upper ends of the end fixed contacts shaped to support a precious metal contact area for engagement by the free end of the movable contact lever. The center fixed contacts may include tangs bent out of the plan of the contact terminal itself to facilitate making electrical connection with the lamps lead wires.

Finally, the present invention is directed to a switch case of the above described variety, that is one which not only has the advantages referred to above, but which is also adapted to be mounted in a generally rectangular panel opening, and wherein the panel may include a range of thicknesses. As mentioned previously the walls of the switch case are integrally connected at their adjacent edges to form four corners, and an integrally formed outWardly projecting peripheral flange is provided adjacent the upper edges of the various walls as is conventional with panel mounted switch cases generally.

In accordance with the present invention four resilient wings are integrally connected adjacent these four corners of the case intermediate the bottom and upper edges of the end walls of the case. These wings are arranged in adjacent pairs and project laterally outwardly with respect to the four corners to which they are connected so that end portions thereof can be resiliently biased to move toward the switch case end walls as the case is inserted in a panel opening. These wing end portions have outside edges that normally extend beyond the end walls themselves but not beyond the side walls of the switch case so that the outside edges of the wings are adapted to engage the end edges of the rectangular panel opening. As a result, these wings are moved angularly about a vertical axis spaced internally relative to the switch case corner itself, and the four corners are preferably relieved in the area between the root of each wing and the peripherally extending flange in order to provide clearance recesses for the wing to be moved as described during installation in a panel opening.

DETAILED DESCRIPTION OF FIGS. 1-10 INCLUSIVELY

Figure 1:
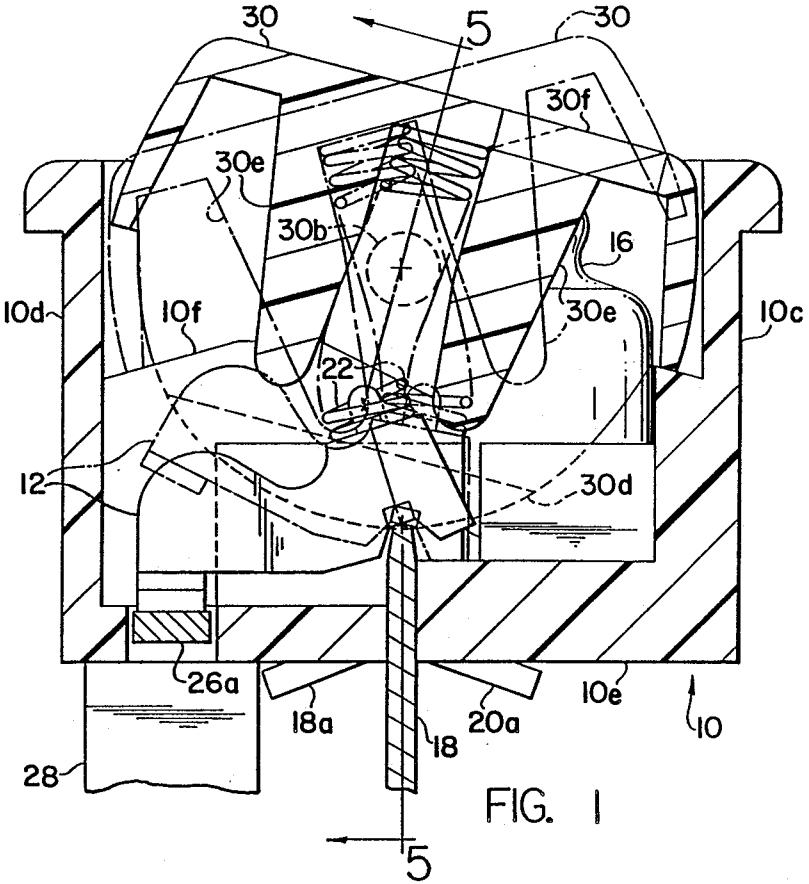
FIG. 1 is a vertical sectional view taken generally on the line 1—1 of FIG. 2 and shows a selectively illuminated rocker switch. Two positions for the rocker and contact are shown in full and in broken lines.
Figure 4:
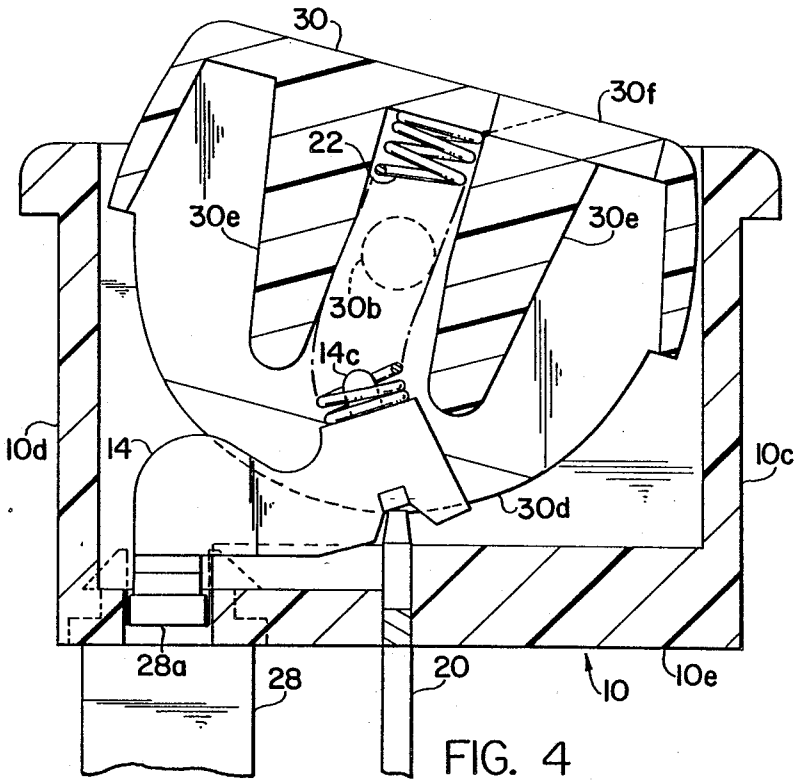
FIG. 4 is a sectional view taken generally on the line 4—4 of FIG. 2.

Turning now to the drawings in greater detail, FIG. 1 shows a miniature rocker switch of the type adapted to fit into a rectangular panel mounting hole (not shown). The size of this switch configuration is such that a typical panel opening might be approximately 0.75 inches×0.50 inches to receive such a miniature switch. In the double pole switch configuration shown in FIGS. 1 and 2 a molded plastic case or switch base 10 has front and rear walls **10*a* and 10*b* intergrally connected to end walls 10*c* and 10*d*, all of which walls are in turn integrally connected to a bottom wall 10*e*. Still with reference to the switch case or base 10 an integrally defined center divider wall best shown in FIG. 3 at 10*f* is provided midway between the front and rear walls 10*a* and 10*b* to define separate cavities for the movable contact levers 12 and 14** respectively.

Figure 2:
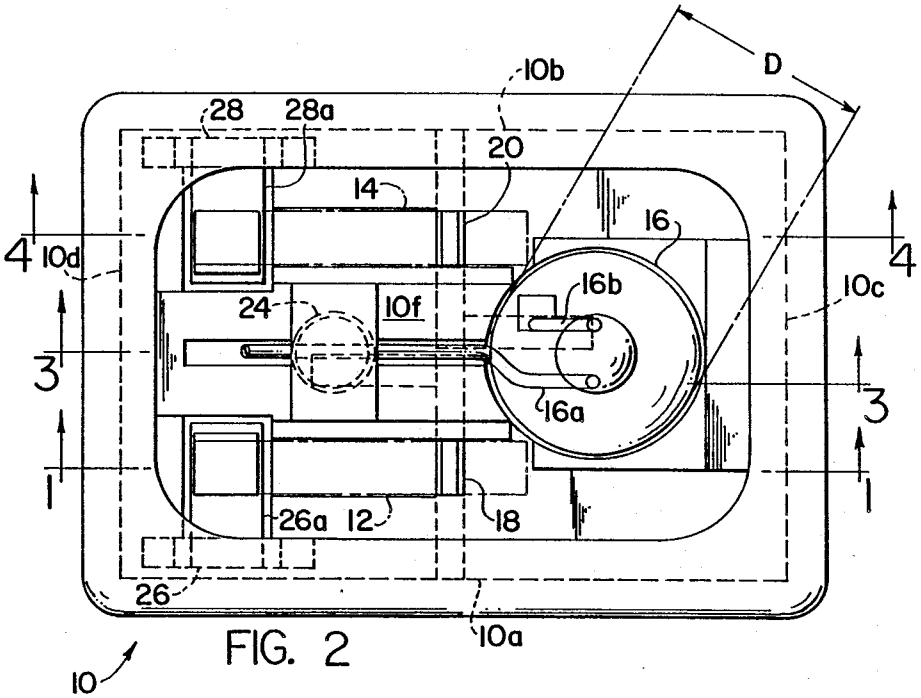
FIG. 2 is a horizontal plan view of the switch illustrated in FIG. 1 but with the rocker being omitted so as to better illustrate the arrangement for the lamp and contact levers inside the switch case, the levers being shown in phantom lines.
Figure 3:
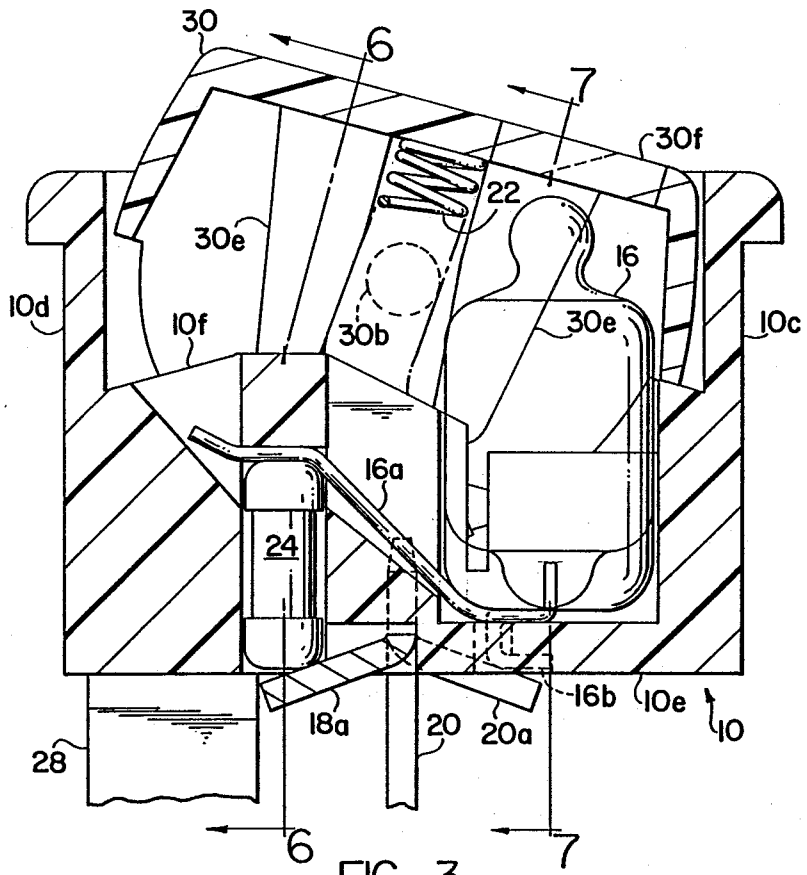
FIG. 3 is a vertical sectional view of the switch illustrated in FIG. 2 being taken generally on the line 3—3 of that view.

As best shown in FIG. 2 these contact levers 12 and 14 are guided by front and rear surfaces of the center divider wall **10*f* during movement of the contact levers between the solid and broken line positions as suggested by the contact lever 12 in FIG. 1. FIG. 2 also shows that these contact levers 12 and 14 are spaced apart from one another by a distance approximately equal to the diameter D of the electrically energizable lamp 16 that is provided in an opening defined for this purpose in the center divider wall 10*f*. As illustrated in FIG. 3 this lamp or bulb 16 has a height of approximately twice its diameter D so as to occupy substantially the entire vertical internal height for the upwardly open switch case cavity. Thus, the miniature switch case 10** accommodates a lamp of conventional configuration.

FIG. 3 also shows the lamp means 16 as including two conductive leads **16*a* and 16*b*, the first of which 16*a* is received in a slot provided for it in the center divider wall 10*f*. The second lead 16*b* extends downwardly through an opening in the bottom wall 10*e* of the case 10 where it is electrically connected to and held in place by a tab 20*a* on one of two center fixed contacts or terminals 18 and 20. FIG. 3 also shows an oppositely bent tang 18*a* on the front fixed terminal 18 that serves to make electrical contact with one end of a resistor element 24 and to hold the resistor element 24 in place. The opposite end of the resistor element 24 engages the conductive lead 16*a* associated with the lamp 16. Thus, the lamp and the resistor element are provided in series with the two center terminals 18 and 20, and by means of one of the two movable contacts 12 and 14 this circuit can be conveniently opened and closed depending upon the position of these movable contact levers as dictated by pivotal movement of actuator 30**. See FIG. 8 for a typical electrical connection setup for the switch of FIGS. 1-7.

Figure 5:
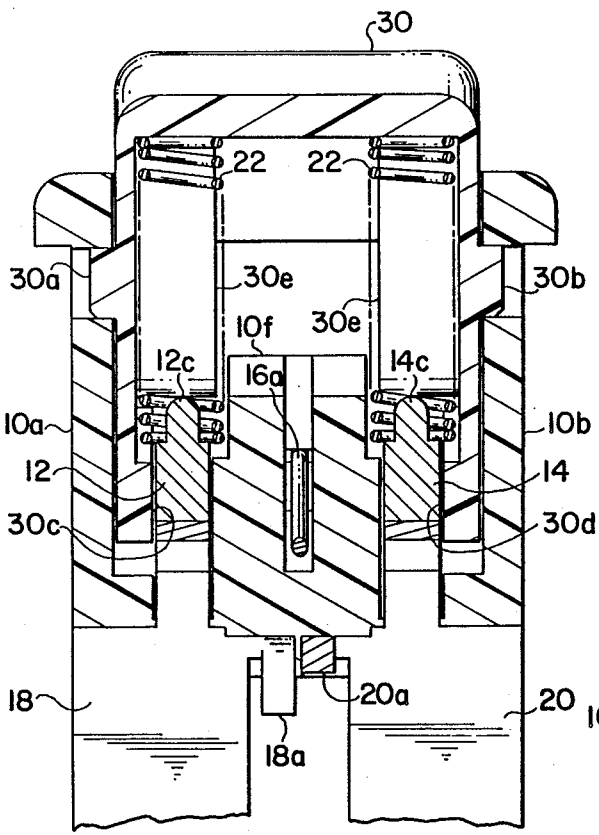
FIG. 5 is a vertical section taken generally on the line 5—5 of FIG. 1.

The actuator 30 is preferably provided in the form of a pivotably mounted rocker having aligned axle defining portions **30*a* and 30*b* received in aligned openings provided for this purpose in the front and rear walls 10*a* and 10*b* of the case 10. FIG. 5 shows this geometry to best advantage and also illustrates two coil compression springs 22, 22 that define spring biasing means to urge the movable contacts 12 and 14 downwardly into contact with the upper ends of the center fixed contacts 18 and 20, and depending upon rocker position, into contact with the fixed end contacts 26 and 28. As shown in FIG. 2 each of these fixed end contacts 26 and 28 has an inturned laterally bent upper end portion 26*a* and 28*a* respectively that is provided below the free end portion of an associated one of the movable contact levers 12 and 14**.

Figure 6:
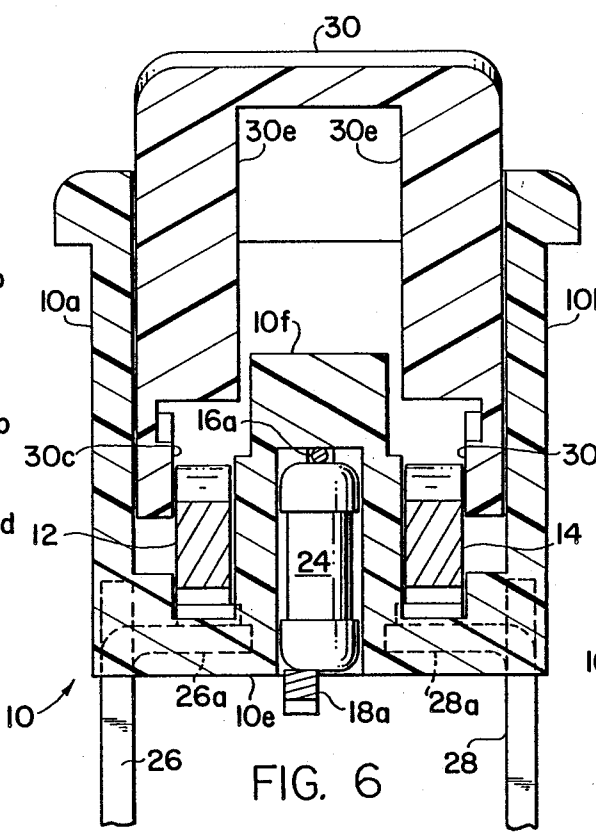
FIG. 6 is a vertical section taken generally on the line 6—6 of FIG. 3.

FIG. 6 shows this configuration for the fixed end contact 26, 28 and also illustrates the free end portions of the movable contact levers 12 and 14 in abutting relationship thereto. This position for the switch (closed) as illustrated in FIGS. 5 and 6, also shows the generally upright configuration for the contact levers 12 and 14. Each lever 12 and 14 comprises a formed metal member of overall length only slightly greater than one-half the length of the switch case cavity, as suggested in FIG. 1, and each said contact lever 12 and 14 has a generally rectangular cross sectional configuration so that when supported at one end, its pivoted end, on a center fixed contact, the levers 12 and 14 are held in upright configuration by the front and rear surfaces of the center divider wall **10*f* and by depending skirt portions 30*c* and 30*d* of the rocker actuator 30**.

As so constructed and arranged movement of the rocker 30 between the two positions shown in FIG. 1 can be accomplished as follows. The coil springs 22 act between the underside of the rocker and a land defining portion of each movable contact lever 12 and 14 located above the pivoted end portion of the contact lever as best shown in FIG. 1. This land against which the coil spring acts can be seen to move in an arc relative the upper end of the fixed contact 18 so as to achieve a stable position for the contact lever and hence for the rocker in both the two switch positions shown. FIG. 5 illustrates the coil springs 22, 22 and the raised land defining area of the contact lever around a spring locating post **12*c* and 14*c* of each of these contact levers 12 and 14. The coil springs 22, 22 are held in place at least within the rocker 30 by depending fingers 30*e*, 30*e* that cooperate with the depending skirts 30*c*, 30*d* for this purpose, all as referred to previously. The springs 22 actually project beyond these fingers 30*e* and this allows freedom of lateral movement for the lower end of the springs 22 as referred to previously to achieve the desired degree of movement of the contact lever 12** between the limit positions shown in FIG. 1.

Figure 7:
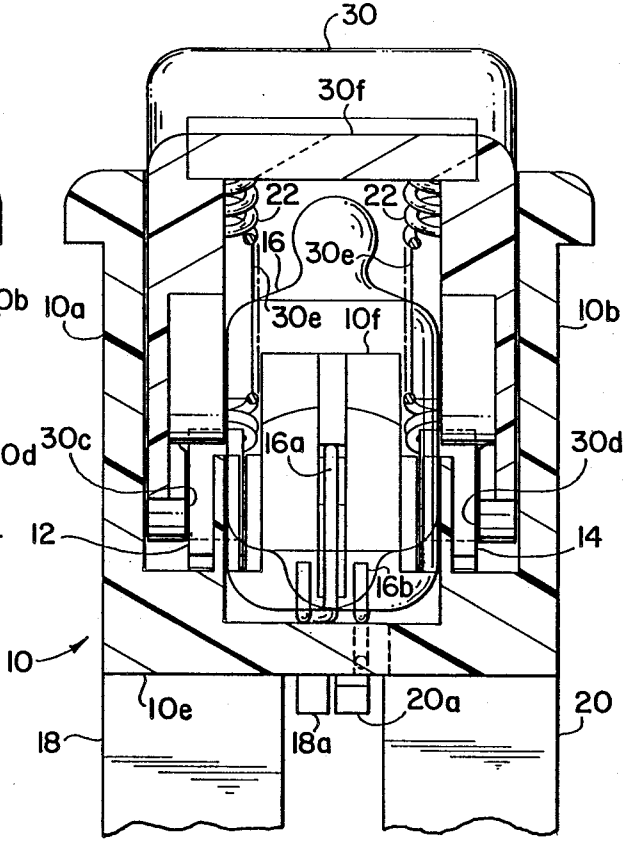
FIG. 7 is a vertical section taken generally on the line 7—7 of FIG. 3.
Figure 10:
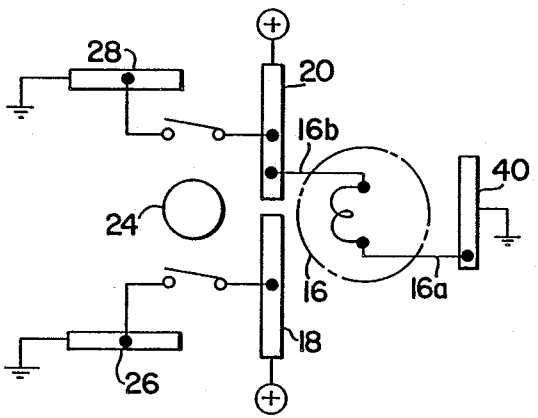
FIG. 10 is a schematic view of still another alternative electrical connection system for the switch wherein the bulb is selectively energized, and wherein the second pole of the switch also provides an independent switching function.
Figure 8:
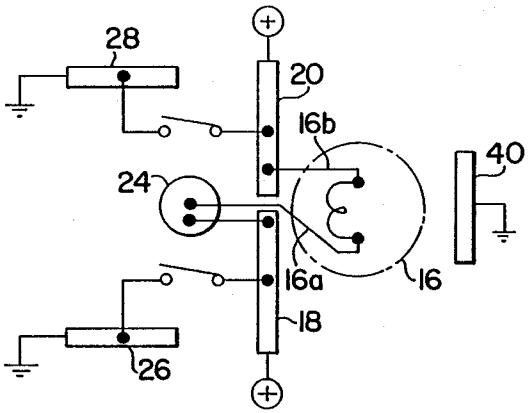
FIG. 8 is a schematic view to illustrate a typical electrical connection set up for a rocker switch of the type shown and described above with reference to FIGS. 1–7 inclusively.
Figure 9:
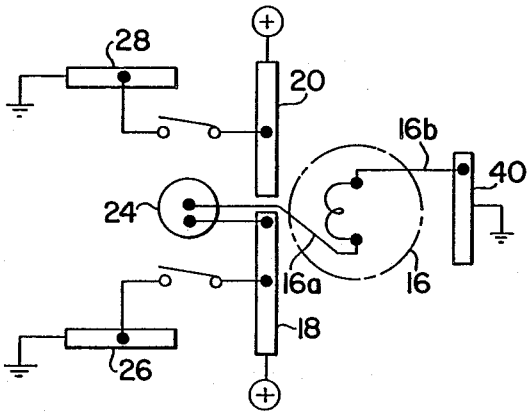
FIG. 9 illustrates an alternative electrical connection setup wherein the lamp is continuously energized, and wherein a second pole of the switch is provided with an independent switching function.

The above described switch construction accommodates a single relatively large lamp 16 in a relatively small miniature switch case so as to selectively illuminate a rocker 30, and more particularly passes light through a window portion **30*f* defined for this purpose in the top surface of the rocker 30 as suggested in FIG. 7. With a terminal configuration such as shown in FIGS. 1-7 supply voltage is imposed across a center contact and an end contact not in the same pole. The other center contact and the lamp will be selectively energizable by movement of the rocker as described above. FIG. 8 shows such a configuration. Note that both end contacts may be at the same potential in the double pole version shown. A fifth fixed terminal provided opposite the two end terminals, is shown in FIGS. 9 and 10, and incidentally is shown but not used in FIG. 8, to provide a continuously energized lamp. As shown in FIG. 9 the center contacts are both positive and the fifth terminal 40 is grounded to energize the lamp 16 continuously. As shown, the resistor 24 is in the lamp circuit. If no resistor is required, as for example if the operating voltage is compatible with the type of lamp being used, no resistor is required. In such a case lamps leads 16***a* could be connected directly to contact 20 or contact 18. FIG. 10 shows such a configuration.

DETAILED DESCRIPTION OF FIGS. 11, 12 AND 13

The rectangular switch case 10 described with reference to FIGS. 1–7 above is intended for use in a panel opening by mounting from the front of a panel. However, the switch case 10 is not shown with structure for securing the case in such an opening. Typically, conventional means for so securing a rectangular switch case would include one or more wings integrally molded to the bottom of the case and extending upwardly at the end of the case. Such wings are resiliently deformable as the case is mounted in a rectangular opening as a result of engagement between the end portions of the panel opening and such wings. The wings of the present invention are designed to operate in a smaller space than is true of the prior art wings.

Figure 11:
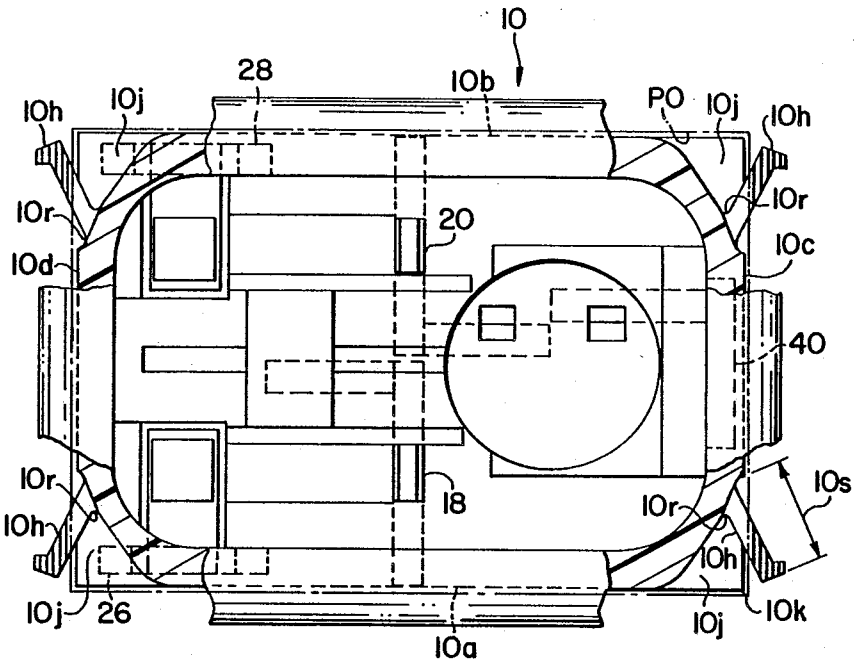
FIG. 11 is a plan view of a switch case, with portions broken away, to reveal in horizontal section the location for the retaining wings provided adjacent the four corners of the case.
Figure 12:
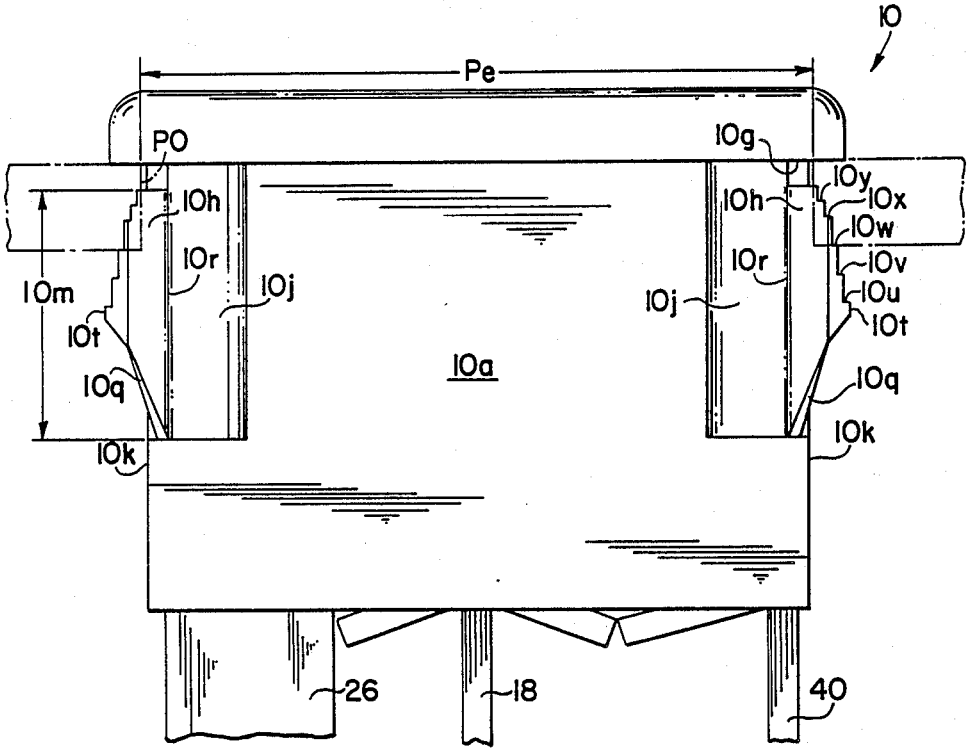
FIG. 12 is an elevational view of the switch case illustrated in FIG. 11.
Figure 13:
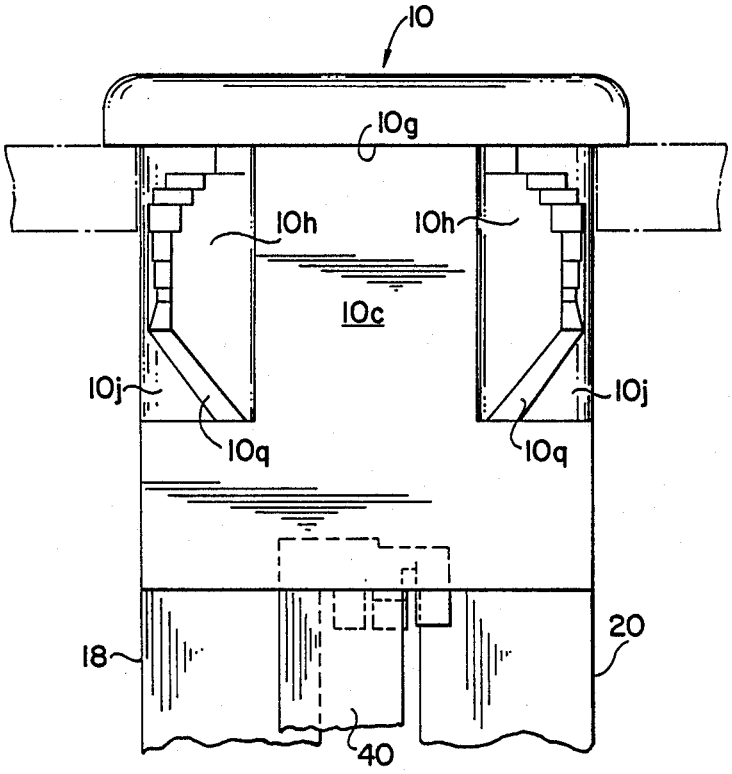
FIG. 13 is an end view of the switch case depicted in FIGS. 11 and 12.

FIGS. 11, 12 and 13 show wings or ears 10*h*, 10*h* molded in the switch case 10 in order to secure the switch case in a rectangular panel opening P0. However, these wings do not project upwardly and outwardly from a lower part of the case 10 as taught by prior art U.S. Pat. Nos. 4,461, 938; 3,706,869; 3,701,870; and other prior art configurations. Rather, the wings 10*h*, 10*h* of the present invention are arranged adjacent the four corners of the case 10 and are movable from their normal projecting postions as shown in FIGS. 11, 12 and 13 into recesses defined at these four corners that are adapted to receive these wings. This geometry provides a significant space saving over prior art wing geometry.

A peripherally extending flange 10*g* is conventionally provided adjacent the upper edges of the case walls 10*a*, 10*b*, 10*c* and 10*d*. This flange 10*g* is shown broken away in FIG. 11 in order to reveal the corner construction of the switch case. The corner construction being illustrated in horizontal section to illustrate the wings 10*h* being pivoted on self-defined hinge axes integrally molded with the switch case. The wing axes are oriented generally perpendicular to the plane defined by the panel and by the peripheral flange 10*g*. In the prior art wings referred to above the axes for the wings are defined integrally with the case but are oriented substantially parallel to the peripheral flange provided at the top of the case. Further, the prior art wing axes are spaced well away from the flange itself in order to function and to secure the case in the panel opening. The present invention provides these axes in closely spaced relationship to the flange as best shown in FIGS. 12 and 13, and provides these axes on a self-defined hinge, and in an orientation that permits movement of these wings so that they not only secure the case in the rectangular panel opening, but so that the wings move into recesses defined at the corners of the case itself. This geometry provides a significant space saving, and is important in the design of a miniature switch. When taken in combination with the illuminated miniature rocker switch shown and described with reference to FIGS. 1–7 this corner wing geometry provides an improved result not shown or suggested in the prior art.

The wing and recessed corner construction in the miniature switch case 10 of the present invention also allows for a significantly larger (longer and deeper) switch case cavity then would be possible with the more conventional wing geometries of the prior art. Still another advantage to the wing and recessed corner construction disclosed and claimed herein is that the fixed end terminals or contacts 26 and 28, as well as the fifth terminal 40, all can be located in openings provided in very close relationship to the case end walls 10*c* and 10*d*.

As shown in FIGS. 11, 12 and 13 the wings 10*h*, 10*h* are not only oriented differently than the prior art wings referred to above, but the wings 10*h*, 10*h* also have significantly different aspect ratios. The aspect ratio can be defined as the ratio of the wing span to the root chord, and it will be apparent that the root chord 10*m* is significantly greater than the span 10*s* of the wings 10*h*, 10*h*. In most prior art wing constructions where the wing root is provided in vertically spaced relationship to the flange 10*g* and is oriented parallel thereto the span of such prior art wings generally is close to the total vertical height dimension of the switch case itself leading to a wing aspect ratio that is greater than one, generally about four to one. In the unique geometry disclosed herein the chord is actually greater than the span leading to an aspect ratio of significantly less than one, and in the switch case shown approximately one to four. Further, both root chord and wing span are significantly less than the height of the switch case itself, leading to a wing configuration that requires less material. Further, the recesses defined behind the wings 10*h*, 10*h* further add to the savings in size and cost of material.

Thus, the wing aspect ratio geometry, and wing hinge axis orientation disclosed herein avoids the necessity for locating the wing root adjacent the bottom of the case end walls, allowing the wing roots to be located in an area of the case where the wing span is shorter, but nevertheless of sufficient strength and resiliency to perform its function of securing the switch case in the panel opening. The relieved corner portions 10*j*, 10*j* of the switch case accommodate the wings 10*h*, 10*h* during the installation of a case in such a panel opening.

As mentioned, the wings 10*h*, 10*h* are integrally molded into the switch case 10 and have their roots 10*r*, 10*r* necked down sufficiently to define self-hinge axes for the wings, which axes are oriented parallel to the case corners 10*k*, 10*k*. These wing roots 10*r* are not actually at the corners, but are parallel thereto, and spaced inwardly thereof as best shown in FIG. 11. Each wing 10*h* has a tapered lower edge 10*q* that engages the ends of the rectangular panel opening P0 as the case is pushed into such a panel opening during installation. An interference fit is thereby provided for movement of the wings 10*h*, 10*h* from normal positions as shown in solid lines in FIG. 11 toward deflected or deformed positions dictated by the residual degree of wing deflection after the case has been mounted in the panel opening P0.

Each wing 10*h* also includes a wing tip 10*t* that will maximize such wing deflection during installation. After the tips 10*t*, 10*t* pass through the panel opening P0 the wing will return toward but never quite reach their normal undeflected positions whereby to resiliently secure the case in the panel opening. Stepped lands 10*u*, 10*v*, 10*w*, 10*x* and 10*y* provide for different degrees of permanent deflection of the wings to accommodate panels of different thickness and/or opening size all as described in prior art U.S. Pat. No. 4,461,938 for example.

The present invention achieves an equivalent retention of the case in the panel opening without the relatively high aspect ratio wings suggested in the prior art, and does so with wings that move on axes parallel to the flange 10g and that fit into recesses 10j, 10j at the switch case corners all as described above.

The unique wing geometry of the present invention provides for a relatively larger switch case geometry to fit within a given panel opening size. For example, a typical "miniature" switch must fit a panel opening of approximately 0.75 inches in length. This defines the switch case size. With the wing geometry described herein the overall length of the switch case is increased over that possible with a prior art miniature switch case of the type fitted with conventional wings all as described above. As shown in FIG. 12 the length Pe of the panel opening P0 corresponds closely to the length of the switch case itself. This geometry provides more space inside the switch case to accommodate the terminals, the contact levers, and in the switch case of FIGS. 1–7 the relatively large lamp means, and its associated resistor. Thus, a miniature switch case of the type disclosed herein is adapted to fit into an opening of 0.75 inches in length, and the switch case itself is only slightly less in length than the length of the opening. This result is not possible with prior art miniature switch case geometries generally, particularly those having conventional wing configurations for mounting the switch case in the panel opening from the front as described above.

As described above with reference to FIGS. 1–10 inclusively the fixed end contacts 26 and 28, and the fifth contact 40, are located as close as possible to the switch case end walls. Further, the length of the movable contact levers need only be such as to span the distance between these end contacts 26 and 28 and the center contacts 18 and 20 respectively. These contacts levers 12 and 14 are just long enough to provide smooth movement between ON and OFF positions as the rocker is pivoted between the positions shown for it in FIG. 1. This geometry allows for a relatively large lamp means to be provided in the opposite end of the switch case all as described above. In summary, the miniature switch case shown and described herein provides internal space for the lamp, two contact levers, and fixed contact terminals located adjacent the end walls of the case by virtue of the unique mounting wing geometry described hereinabove for retaining the switch case in a relatively small rectangular panel opening.

I claim:

1. A switch case adapted for mounting in a generally rectangular panel opening, said opening having side and end edges, and said panel having a range of thickness, said case comprising an upwardly open generally rectangular housing with first and second opposed pairs of walls associated with said opening side edges and end edges, said walls integrally connected at their adjacent vertical edges to form four corners, said housing having a bottom wall, said pairs of walls having bottom edges integrally joined to said bottom wall, said housing also having an integrally formed outwardly extending peripheral flange, said first and second pairs of walls having upper edges adjacent said peripheral flange, and four resilient wings integrally connected to the case end walls intermediate the bottom and upper edges thereof, said wings arranged in adjacent pairs and each wing having a root end defining a hinge axis oriented parallel to one of said case corners, each wing having a tip that is adjacent one of said case corners and adapted to be resiliently based to move toward said case end wall during panel mounting, said wings having outer portions that normally extend beyond said case end walls but not beyond the side walls of the switch case so that said outer portions of said wings are adapted to engage the end edges of the rectangular panel opening as a result of which said wings are pivoted about vertical axes spaced inwardly of said switch case corners during the mounting of the switch case in the generally rectangular panel opening.

2. The combination of claim 1 wherein each of said wings has a span direction and dimension, and each of said wings further has a leading edge that is swept back relative to said span direction to cause the wing to deflect as a result of engagement between the panel opening end edge and said wing leading edge.

3. The combination of claim 2 wherein each of said wings has a root dimension greater than the span dimension thereof.

4. The combination of claim 3 wherein said wing outer portions have a stepped geometry and define lands for locking into the edges of panel openings of various sizes and panel thickness.

5. The combination of claim 3 wherein the ratio of said span dimension to said root dimension is approximately ¼.

6. The combination of claim 2 wherein said switch case corners are relieved behind said wings to define recesses for receiving said wings as the wings are deflected during engagement with said panel opening edges.

7. The combination of claim 6 wherein each of said wings has a root dimension greater than the span dimension thereof.

8. The combination of claim 7 wherein each of said wing outer portions has a stepped geometry and defines lands for locking into the edges of panel openings of various sizes and panel thickness.

9. The combination of claim 6 in said case has at least two fixed end terminals, each said end terminal located adjacent one of said case end walls, said terminals having upper end portions inside said switch case.

10. The combination of claim 9 further comprising at least one fixed center terminal provided generally intermediate said two fixed end terminals, at least one movable contact lever having a pivoted end supported on an upper end of said fixed center terminal and having a free end for selectively contacting one of said two fixed end terminal upper end portions, a lamp provided intermediate the second of said two fixed terminal upper ends and said fixed center terminal upper end, said lamp having conductive leads, one of said leads connected to said second fixed terminal.

11. The combination of claim 10 further characterized by a second fixed center terminal aligned with said one fixed center terminal and said lamp having a second conductive lead connected to said second fixed center terminal.

12. The combination of claim 11 wherein said switch case has a divider wall defining front and rear upwardly open cavities inside said case, at least one additional end terminal aligned with said one fixed end terminal, and a second movable contact lever having a pivoted end and a free end for support and selective terminal with said second center and said additional end terminal respectively.

13. The combination of claim 12 wherein said lamp is of generally cylindrical shape with a diameter D and a height 2×D, said movable contacts being spaced apart at least by said dimension D.

14. The combination of claim- 13 further characterized by an actuator movably mounted in said case, spring means provided in part in said actuator and having parts acting on said movable contacts to pivot said movable contacts in response to actuator movement.

15. The combination of claim 14 wherein said actuator comprises a rocker pivotably mounted in said upwardly open case, said rocker having a top defining a window for emitting light from said lamp, said rocker having front and rear skirt portions defining spring supporting recesses, said spring means comprising two coil springs, said coil springs having upper ends provided in said supporting recesses of said rocker skirt portions, said spring means in part comprising lower ends of said coil springs, said lands comprising spring locating lugs on said movable contacts.

16. The combination of claim 15 wherein said movable contacts comprise vertically oriented generally flat levers of limited lateral dimension slidably supported between said rocker skirt portions and said divider wall so as to remain in the same plane as they pivot between open and closed positions corresponding to switch open and switch closed conditions respectively.

17. The combination of claim 16 wherein said fixed contact terminals comprise vertically oriented generally flat terminal strips, said center fixed terminals being in a common vertical plane and said tangs being bent out of said plane in opposite directions.

* * * * *